US008464447B2

(12) United States Patent
Pemberton

(10) Patent No.: US 8,464,447 B2
(45) Date of Patent: Jun. 18, 2013

(54) SIGNAGE APPARATUS HAVING SIMPLE MAGNET-BASED STRUCTURE FOR EASE OF MODIFICATION

(76) Inventor: Kirk Pemberton, Gardena, CA (US)

( * ) Notice: Subject to any disclaimer, the term of this patent is extended or adjusted under 35 U.S.C. 154(b) by 180 days.

(21) Appl. No.: 12/930,845

(22) Filed: Jan. 18, 2011

(65) Prior Publication Data

US 2011/0113661 A1 May 19, 2011

Related U.S. Application Data

(63) Continuation-in-part of application No. 12/460,570, filed on Jul. 21, 2009, now Pat. No. 8,205,369, which is a continuation-in-part of application No. 11/653,063, filed on Jan. 12, 2007, now Pat. No. 7,870,687.

(51) Int. Cl.
*G09F 7/04* (2006.01)

(52) U.S. Cl.
USPC ..... 40/600; 40/661.01; 40/568; 40/575; 40/576

(58) Field of Classification Search
USPC ..... 40/600, 661.01, 568, 575, 576, 711
See application file for complete search history.

(56) References Cited

U.S. PATENT DOCUMENTS 3,965,599 A * 6/1976 Ebner ..... 40/711
4,475,300 A * 10/1984 Ledenican ..... 40/600
4,837,953 A * 6/1989 Tannenbaum ..... 40/124
5,172,503 A * 12/1992 Dane et al. ..... 40/600
5,502,907 A * 4/1996 Wang ..... 40/711
5,901,486 A * 5/1999 Sharon et al. ..... 40/618
6,003,258 A 12/1999 Godfrey et al.
6,182,387 B1 2/2001 Duguay
6,282,825 B1 * 9/2001 Godfrey et al. ..... 40/611.01
2005/0005489 A1 * 1/2005 Ridenour et al. ..... 40/600
2006/0117617 A1 * 6/2006 Peterson et al. ..... 40/1.6
2007/0204500 A1 * 9/2007 Splittgerber ..... 40/781

* cited by examiner

*Primary Examiner* — Gary Hoge
(74) *Attorney, Agent, or Firm* — Leonard Tachner

(57) ABSTRACT

A readily modifiable modular sign apparatus is especially useful for use as easily changed advertisement media such as in department stores and retail stores. In one embodiment, the apparatus comprises a preferably translucent substrate or mounting board which is preferably planar and has a front surface and a back surface. Precisely positioned holes are prepared at selected locations. These holes are formed to be aligned with thin metal shims which are affixed on the back surface of the mounting board and receive cylindrical magnets on the front surface. The magnets are attached directly to the rear of printed sheets, each of which may have wording or pictorial information or both. The magnets contact the metal shims through the mounting board holes, and are held firmly in position by virtue of both the magnetic attractive force and the shape of the walls of the mounting board holes. The printed sheets may be provided with indicia carriers to permit personnel to change just numerical data such as prices without the requirement to replace the entire printed sheet. In the preferred embodiment of the present invention, such indicia carriers are affixed directly to the front surface of the printed sheets by a separate magnetic structure that provides easy access to the numerical indicia.

9 Claims, 16 Drawing Sheets

A. Steel bracket (with magnet)
B. Snapcap/metal holder (on graphic)
C. Reposition hole
D. Bracket mounting holes Front view of window frame for design A,B, or C DESIGN A.
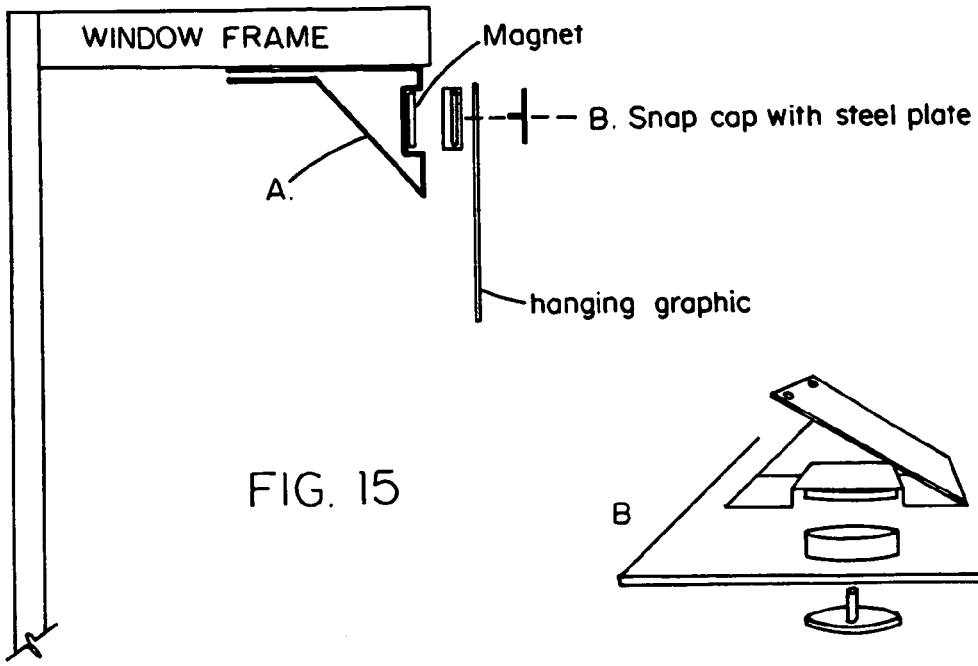
FIG. 15
FIG. 17
DESIGN B.
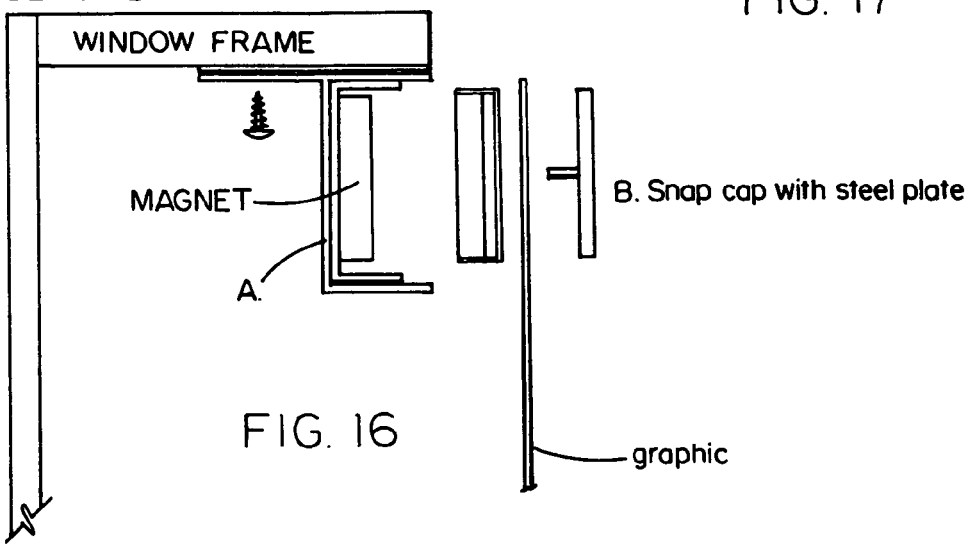
FIG. 16
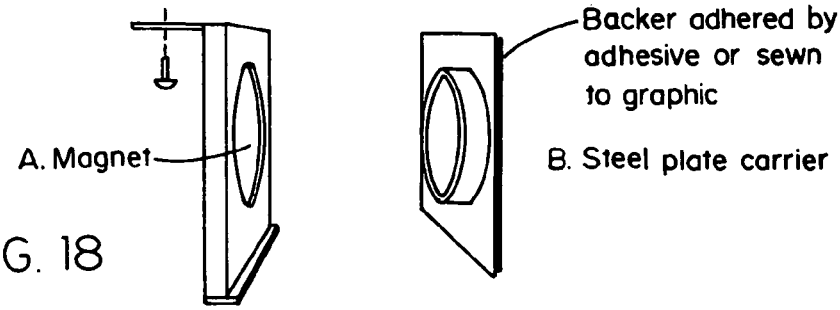
FIG. 18

SIGNAGE APPARATUS HAVING SIMPLE MAGNET-BASED STRUCTURE FOR EASE OF MODIFICATION

CROSS-REFERENCE TO RELATED APPLICATIONS

This application is a continuation-in-part of U.S. patent application Ser. No. 12/460,570 filed Jul. 21, 2009 which is a continuation-in-part of U.S. patent application Ser. No. 11/653,063 filed Jan. 12, 2007 (now U.S. Pat. No. 7,870,687).

BACKGROUND OF THE INVENTION

1. Field of the Invention

The present invention relates generally to signs of the type used in department stores and other retail stores. More specifically, the invention herein relates to a readily modifiable graphic sign which employs a relatively simple magnet-based structure to facilitate easy modifications by non-technical personnel.

2. Background Art

Modular panel signs are most commonly found in fast food restaurants for display of their food menu in both outdoor and indoor applications. Such signs are usually backlighted and often contain verbal and graphical descriptions of food items and their respective retail prices. One of the key attributes of such menu signs is that they're usually the best and often the only source of menu information for the retail consumer in the restaurant or in the drive-through lane of the restaurant. Therefore, such signs are of critical importance to the successful operation of the restaurant. Their price information is very important as is their graphics which may both provide information about and entice the prospective fast food consumer to purchase a particular food item based on its visual appearance. A common characteristic of restaurants and other food-oriented retail establishments, particularly fast food stores, is that their menu changes often. Either the food items or the respective prices for food items or both, will change frequently to accommodate new offerings, delete less popular items and reflect virtually constantly revised prices to respond to competition or to comport with media advertising. For this reason, it is important that signs are relatively easy to update frequently and that signs can be modified by unsophisticated personnel without requiring elaborate and expensive training.

Issued U.S. Pat. Nos. 6,003,258 and 6,282,825 to Godfrey et al disclose one prior art sign assembly which addresses the need for a menu board type display which can be modified to other content including price information. The sign assembly of the Godfrey et al patents comprises a frame design having distinct front and rear portions as shown, for example, in their FIG. 6. The rear portion comprises a frame and the front portion comprises a mechanically mating transparent cover panel which holds a plastic sheet and a sign element which has graphics printed thereon. The cover panel uses magnetic strips to adhere to the frame at mating metallic strips which are adhesively secured to the frame at matching locations. Separate retention members and stop elements are employed to prevent the sign from sliding out of position. The sign element may be in the form of elongated strips as shown in their FIG. 21. Each such strip is disclosed as having a front piece and a back piece. The front piece has a number of rectangular windows and the back piece has a corresponding number of aligned price pockets for holding inserted numerical indicia for displaying price information through the windows of the front piece. The front piece also has alphanumeric characters which may be printed thereon.

Another readily modified sign assembly for similar applications is disclosed in U.S. Pat. No. 6,182,387 to Duguay. This patent discloses a sign assembly having a magnetically attractable uniform surface completely covered by individual magnetic strips and price elements. Each such strip or element comprises a solid front surface bearing printed indicia and a magnet or magnetic strip affixed to the rear of the front surface. The magnet covers only a portion of the rear of the front surface so that a fulcrum point is formed to permit removal and replacement of the element or strip without special tools. A problem with such a sign assembly is that such a large plurality of separate sign elements do not provide a uniform and professional-looking appearance. Additionally, even with relatively strong magnets, the individual elements would tend to slide off of their intended positions.

Although the prior art disclosures address the need for a sign assembly that can be modified to accommodate frequent changes in food items and their respective prices, there are a number of disadvantages which remain. For example, the number of steps required to change a display are still greater than is desired. The structural complexity of the assembly is still higher than is preferred. The use of a frame of a particular size would make it disadvantageous to change the dimensions of the preferred sign graphics. The use of price pockets on a back piece that need to extend through aligned windows on a front piece, put undesirable constraints on the dimensions and manufacture of the signs and make the price pocket concept unnecessarily complex. The need for locking or stop elements to prevent sliding movement of the printed sign element within the assembled frame is also a disadvantage because it adds to the parts count and cost of the assembly. Moreover, a sign having a large number of individual magnetic pieces does not present a professional finished appearance.

Therefore, there is still an unresolved need for a readily modified signage apparatus which overcomes the noted deficiencies of the prior art. More specifically, it would be highly advantageous if there were a sign assembly which did not require a frame structure, which did not need separate locking or stop elements, which did not utilize separate front and back pieces for price pockets, which was of even simpler structure, which required even fewer steps to change sign content and which still provided a neat, finished and professional looking appearance.

SUMMARY OF THE INVENTION

The present invention, in one embodiment, provides a simple and advantageous solution for the previously unresolved need for a readily modifiable modular sign apparatus that is especially useful for fast food restaurants as backlighted menu boards in both indoor and outdoor applications. The apparatus comprises a preferably translucent substrate or mounting board which may be made of an acrylic or other rigid material including, for example, polycarbonate or styrene. The mounting board is preferably planar and has a front surface and a back surface and in a preferred embodiment is about 5 mm in thickness. Precisely positioned holes are prepared at selected locations. These holes are formed to be aligned with thin metal shims which are affixed on the back surface of the mounting board and receive cylindrical magnets on the front surface. The magnets are attached directly to the rear of printed sheets, each of which may have wording or pictorial information or both. The magnets contact the metal shims through the mounting board holes, and are held firmly in position by virtue of both the magnetic attractive force and the shape of the walls of the mounting board holes. The mounting board holes are preferably beveled toward the front surface of the board to make it easier to locate the magnets accurately and to remove them when it is desired to replace the printed sheet.

The printed sheets have precise, selected dimensions to fill a desired space on the substrate or mounting board, while at the same time, having one or more edges which closely align with one or more corresponding edges or borders of the mounting board. For example, where a printed sheet is rectangular in shape, its upper edge may be substantially congruent to the upper edge of the mounting board. This alignment precision is dependent on the location of the holes and metal shims on the mounting board and on the accuracy of placement of the magnets that are affixed on the back surface of the printed sheets.

Changing the content of a sign of the present invention, involves the simple steps of removing a sheet by pulling the sheet and its adhered magnets away the mounting board and replacing it with another printed sheet having magnets which mate with the mounting board holes. Border or edge members made of plastic or other inexpensive materials, may be preferably used between adjacent printed sheets to provide a neat finished appearance. Such border members may be secured to the mounting board using holes and metal shims and adhered magnets in the same manner as the printed sheets are secured.

The printed sheets may be provided with indicia carriers to permit personnel to change just indicia without the requirement to replace the entire printed sheet. In one embodiment of the present invention, such carriers are affixed directly to the front surface of the printed sheets in a structure that provides easy access to the indicia.

The mounting board may be provided with a large number of extra holes with affixed metal shims so that the size and shape of the printed sheets may be altered as well, by simply adjusting the locations of the affixed magnets on the replacement sheets. This feature provides the added flexibility of changing the module geometry of a modular sign assembly without replacing the mounting board.

The magnets referred to herein are not limited to any particular type or material, however, it has been found advantageous to employ relatively strong magnets that can be provided in virtually any size and shape. In that regard, the preferred magnets employed in the various embodiments disclosed herein are neodymium magnets which are readily available from a number of commercial sources and which are selected from many available sizes and shapes for use herein.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which:

FIG. 4, comprising

FIG. 5, comprising

FIG. 6, comprising

FIG. 9 is a schematic side view of a magnetic based sign attachment system for retail stores and the like;

FIGS. 15-18 show various window frame attachment techniques employed using the present invention;

DETAILED DESCRIPTION OF PREFERRED EMBODIMENTS

Figure 1:
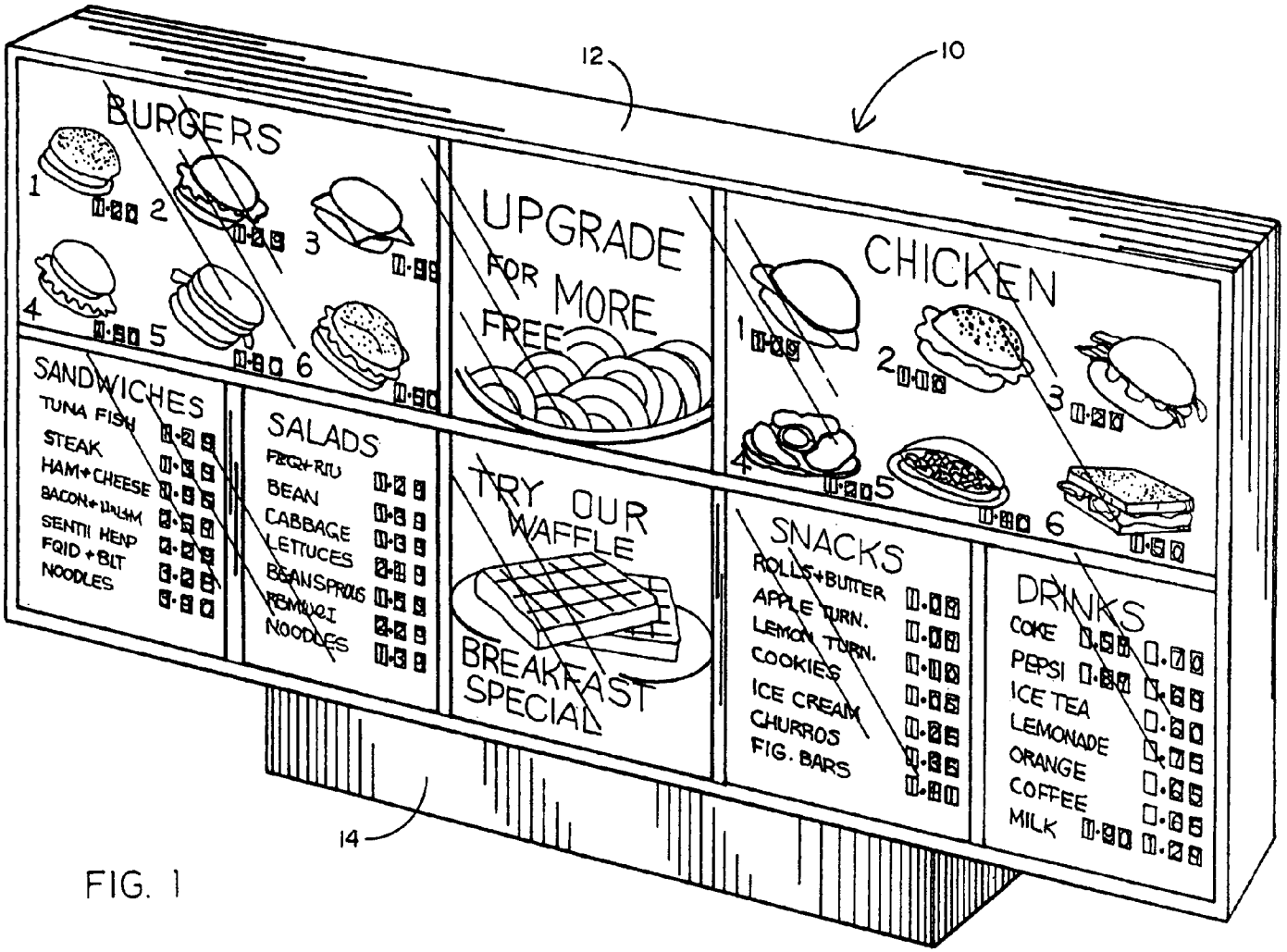
FIG. 1 is a three-dimensional view of a fast food outdoor modular, backlighted sign display in which a preferred embodiment of the invention is employed.
Figure 2:
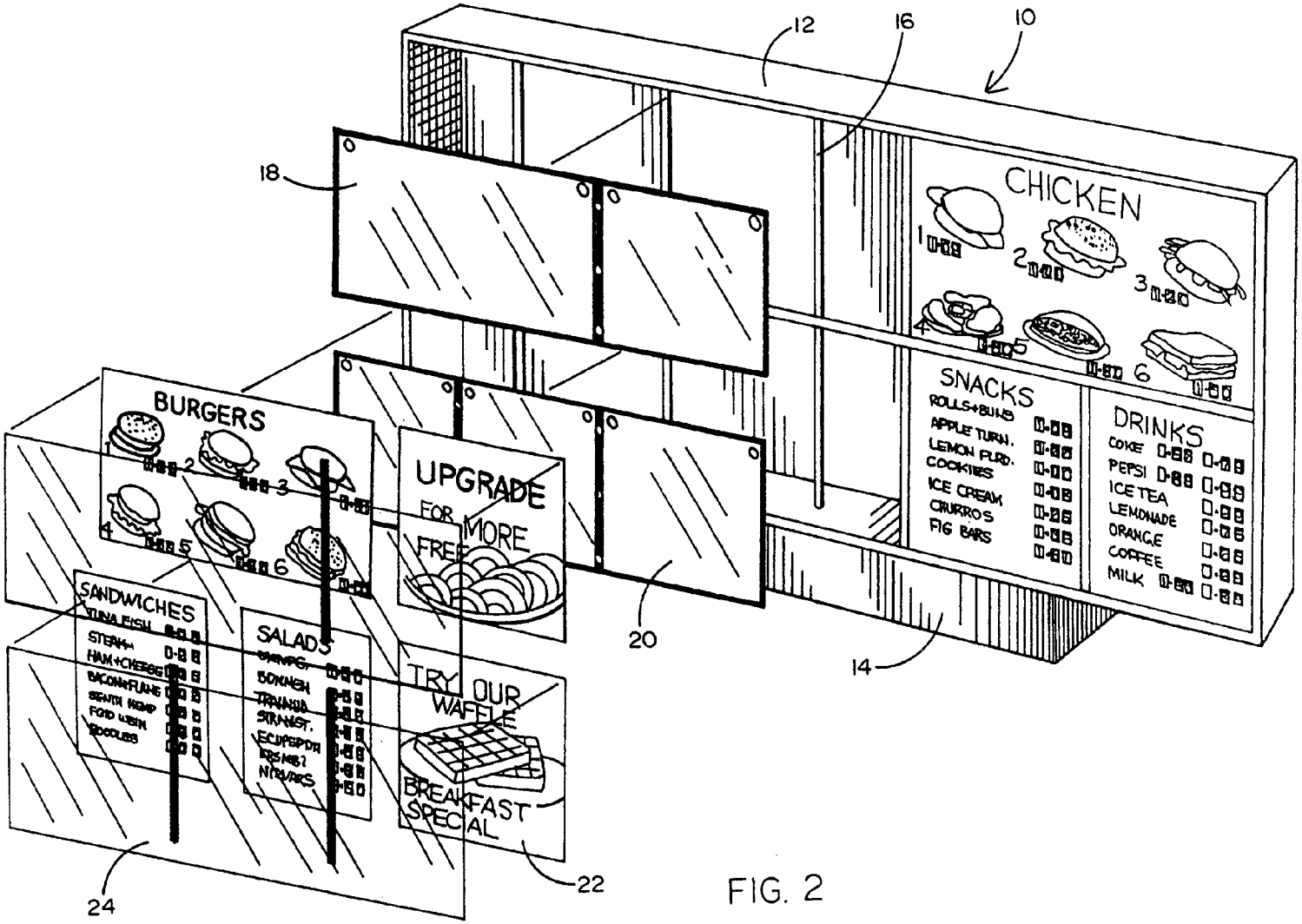
FIG. 2 is a partially exploded view of the sign display of FIG. 1.
Figure 3:
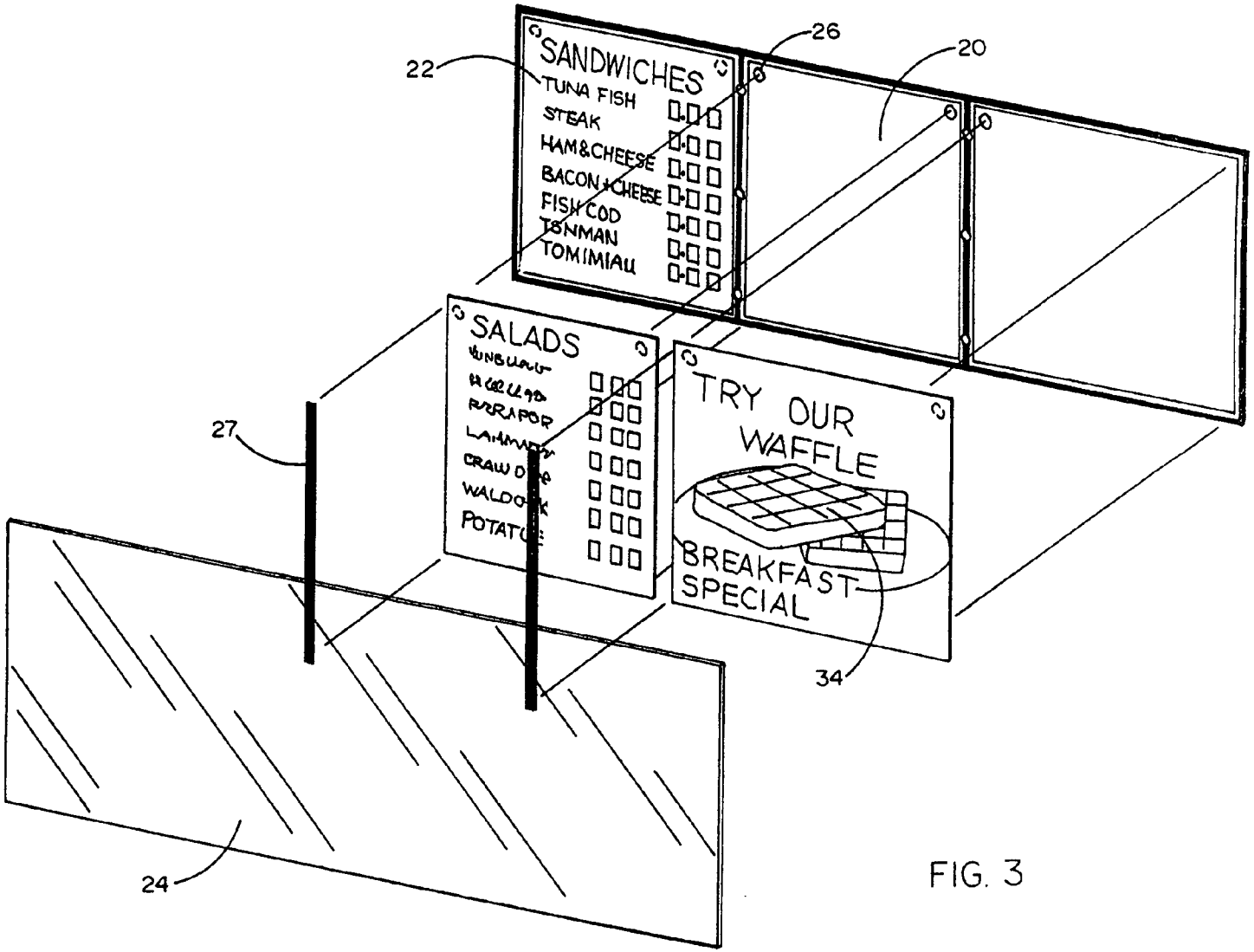
FIG. 3 is a further enlarged and exploded view of a selected module of the sign display of FIG. 1.

Referring to the accompanying drawings and initially to FIGS. 1-3, it will be seen that a modular display 10 comprises a rectangular enclosure 12 resting on a base 14. The enclosure 12 has a plurality of backlights 16 in the form of vertical fluorescent tubes. A plurality of rectangular mounting boards 18, 19, 20 and 21 are positioned in front of the backlights 16. Each such mounting board is covered by one or more printed sheets 22. A transparent hard plastic protective cover 24 overlies the printed sheets. Between each pair of adjacent printed sheets 22 is an edge member 27.

Figure 4A:
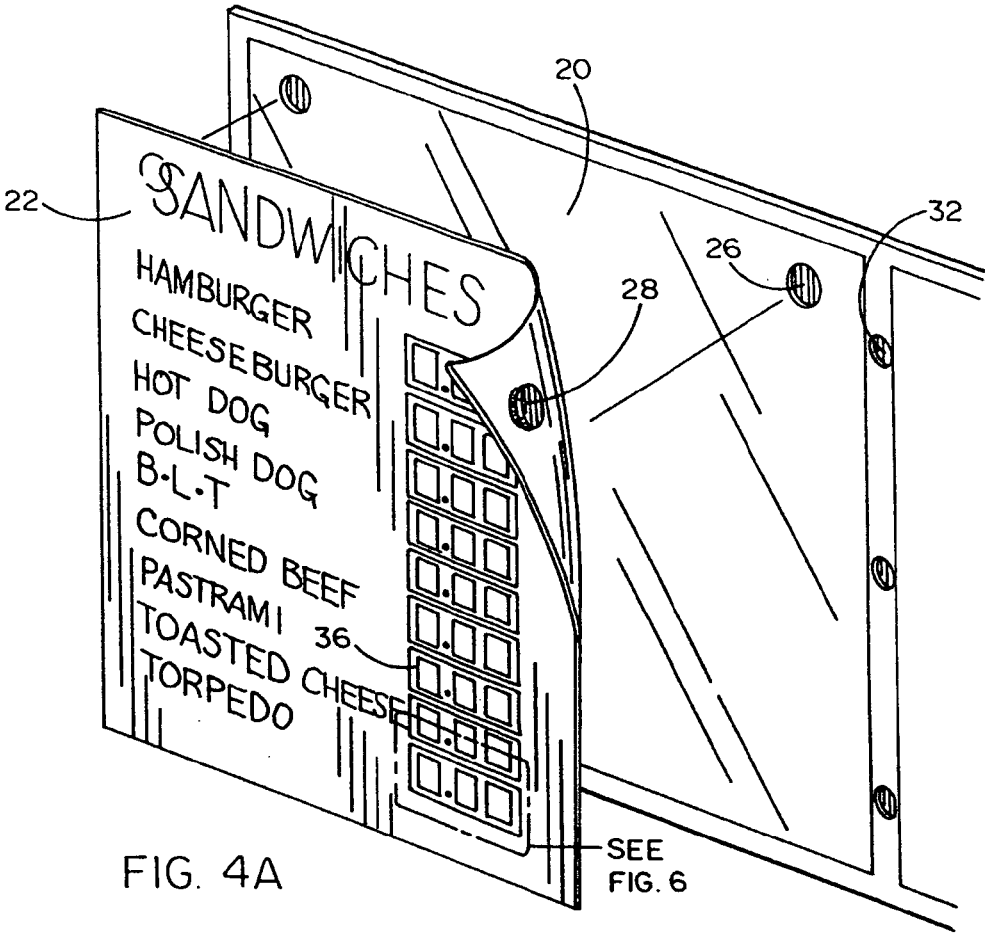
FIGS. 4A, 4B and 4C, is a still further enlarged view of a portion of a selected module of the sign display of FIG. 3.
Figure 4B:
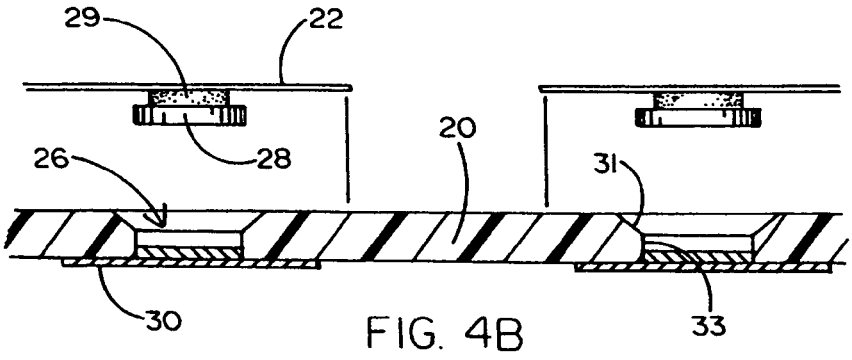
Figure 4C:
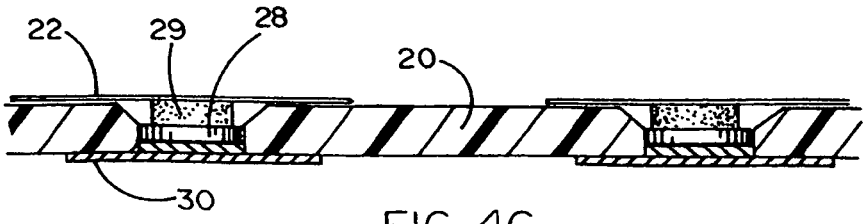

The manner in which the printed sheets and edge members are secured to the mounting board is shown in FIGS. 4 and 5. Referring first to FIG. 4, it will be seen that each printed sheet 22 is attached to the mounting board at a pair of apertures 26 using a corresponding pair of flat cylindrical magnets 28. Each such magnet is adhesively affixed to a sponge-like material 29 which is, in turn, glued to the back of the printed sheet 22 at precisely selected locations. As shown best in FIGS. 4B and 4C, the back surface of the mounting board has a round metal shim 30 aligned with each aperture 26 and adhered to the mounting board surface. Each such aperture 26 has a beveled front portion 31 and straight-walled portion 33. The magnets 28, each extend through the beveled portion 31 and rest in the straight-walled portion 33 where it contacts the metal shim 30.

Figure 5A:
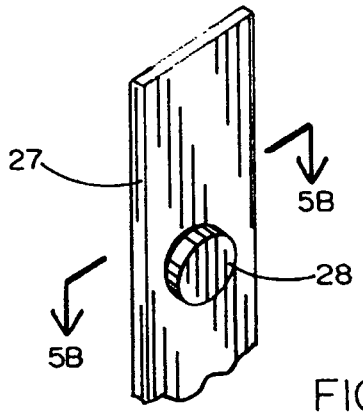
FIGS. 5A, 5B and 5C, is a view of an edge member used in the preferred embodiment.
Figure 5B:
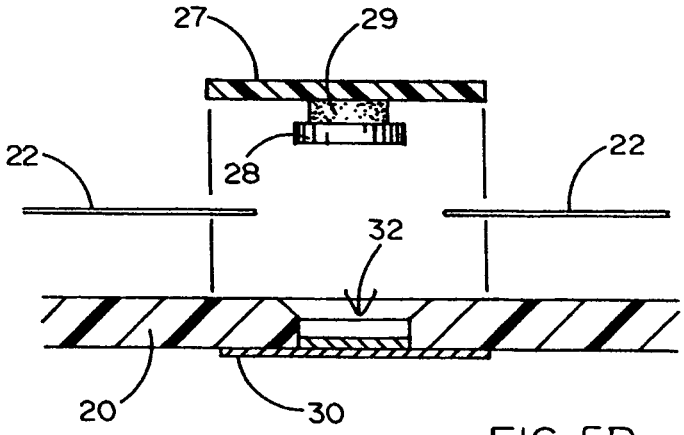
Figure 5C:
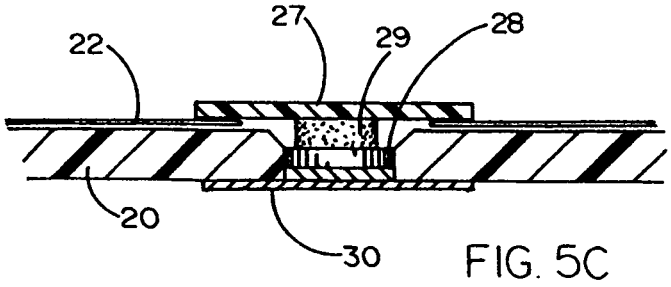
Figure 8:
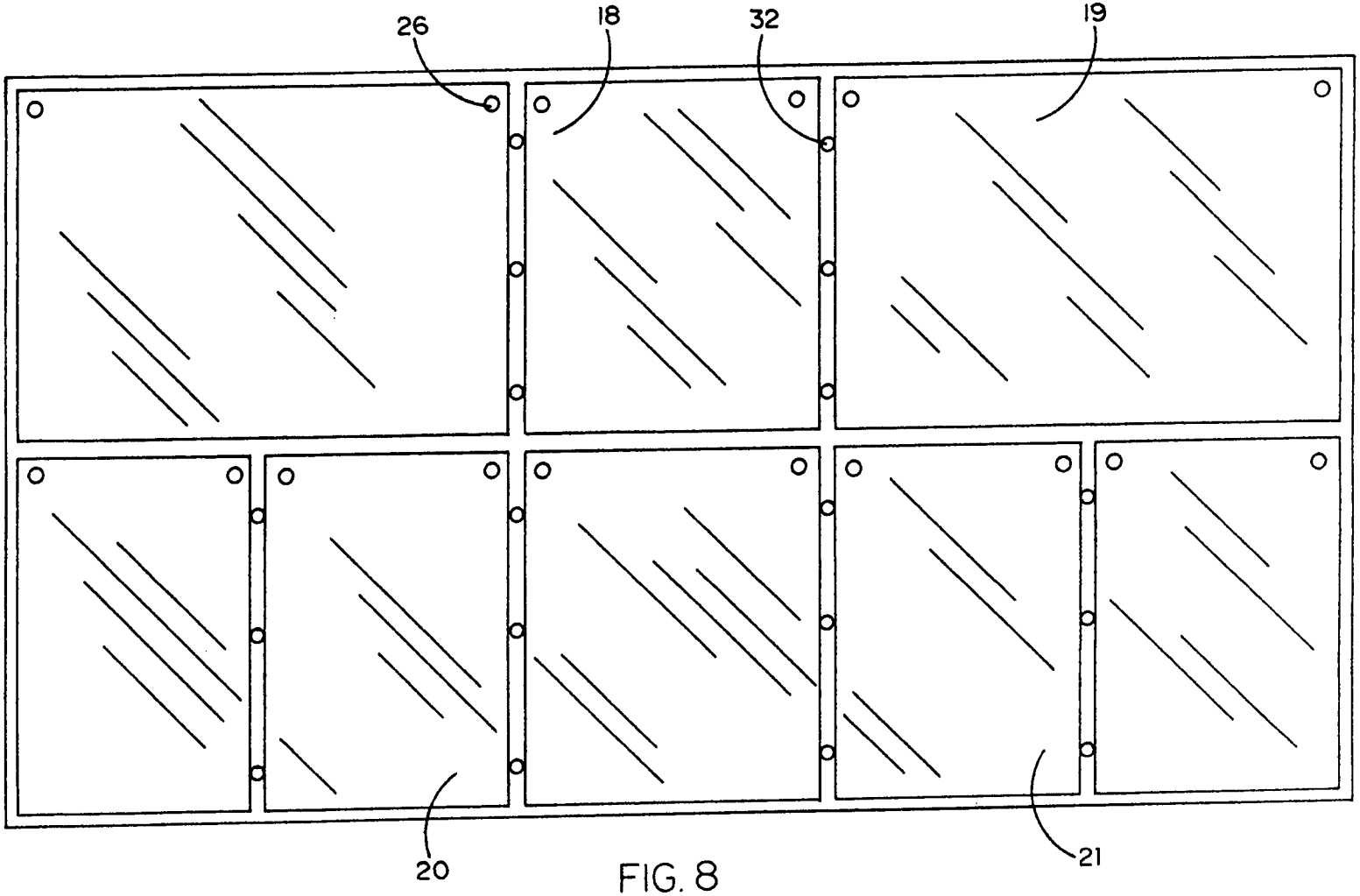
FIG. 8 is a plan view of a mounting board assembly of the sign display of FIG. 1.

As shown in FIGS. 5A, 5B and 5C, each edge member 27 is connected using a plurality of the magnets 28 in mounting board apertures 32. Each such aperture 32 has the same structure (i.e. partially beveled, partially straight) as the aperture 26 and also terminates in a round metal shim 30. The edge members 27 preferably overlap the adjacent edges of two sheets 22 to provide a finished, neat look to the display. The relative positions of the mounting boards 18, 19, 20 and 21 and their respective apertures 26 and 32 are shown in FIG. 8 for the entire modular display 10.

Figure 6A:
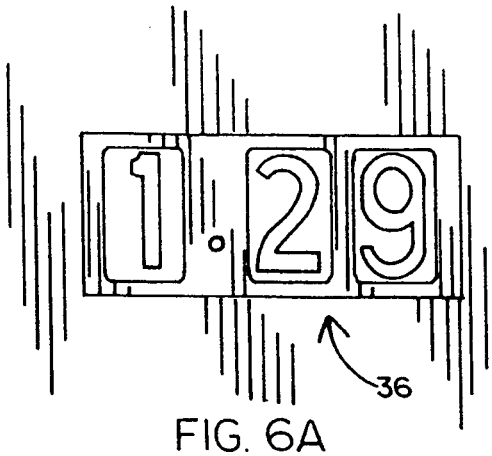
FIGS. 6A, 6B and 6C, is a view of a price carrier construction of the preferred embodiment.
Figure 6B:
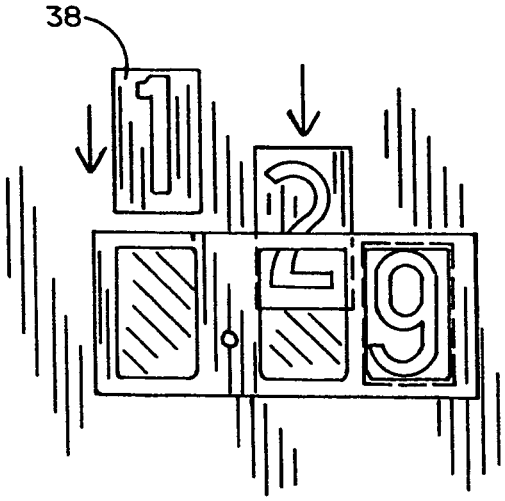
Figure 6C:
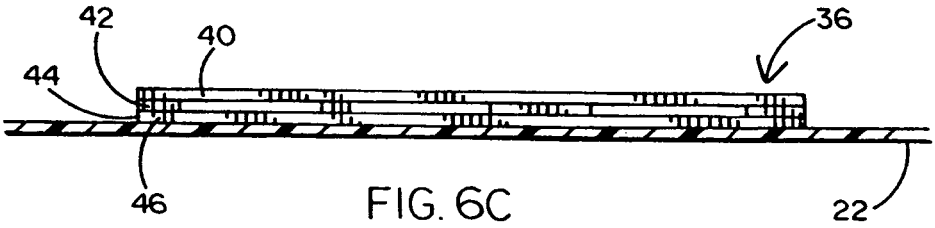
Figure 7:
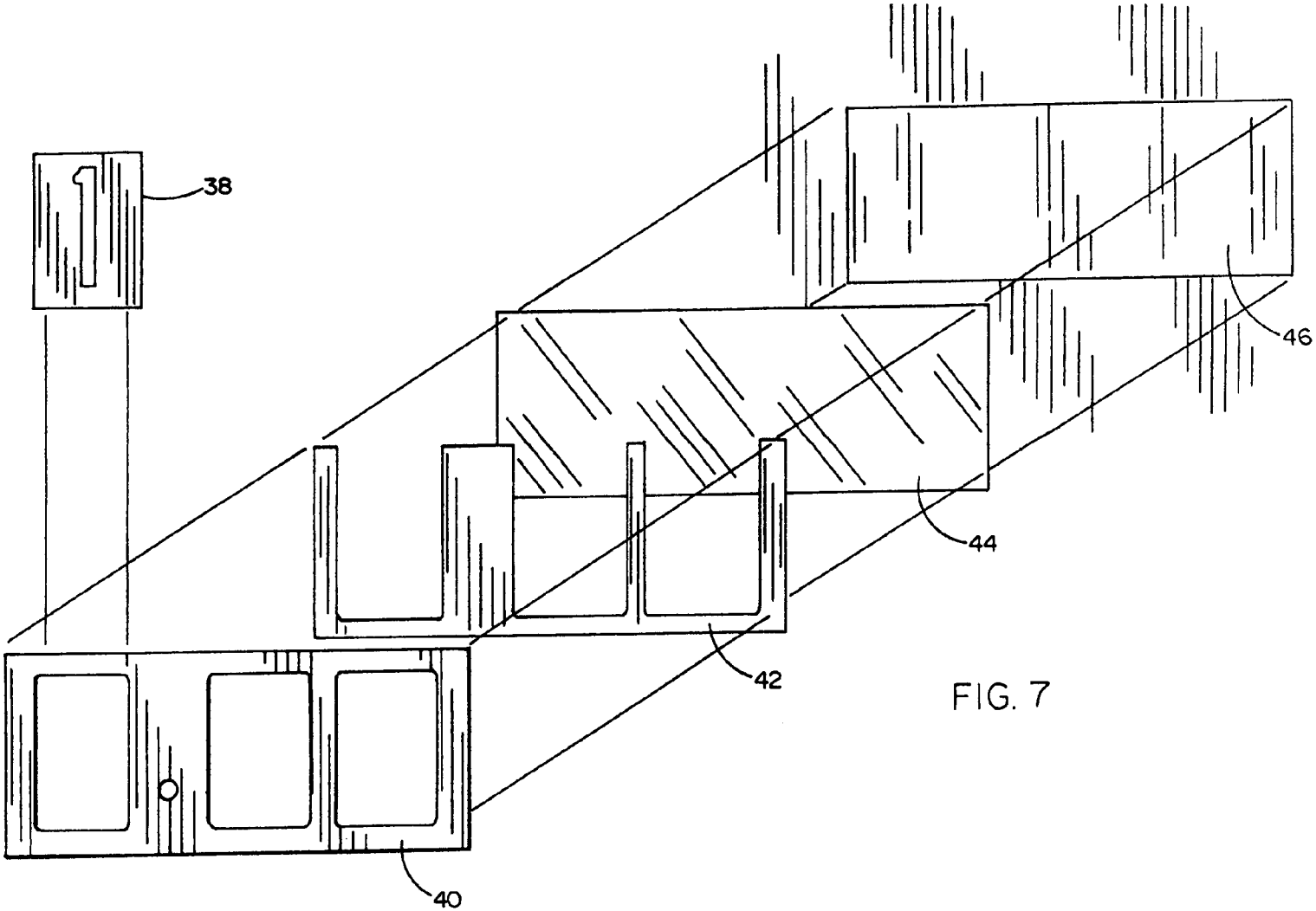
FIG. 7 is an exploded view of the price carrier of FIG. 6.

As seen in FIGS. 3 and 4A, some of the printed sheets 22 may have graphics 34 and/or wording 35 as well as price carriers 36. Price carriers permit price changes to be made without replacing the sheets. Their structure is shown in FIGS. 6A, 6B, 6C and 7. As shown in those figures, a price carrier 36 according to a preferred embodiment of the present invention, comprises at least one number sheet 38, a window member 40, a number sheet holder 42, a slip member 44 and a backing 46. These constituent parts are adhesively assembled as shown in FIG. 7 and then secured to the front surface of a printed sheet 22 as shown in FIG. 6C. The number sheets 38, reflecting the current price of a product, are then inserted as shown in FIG. 6B to provide a selected price as shown in FIG. 6A.

Figure 10:
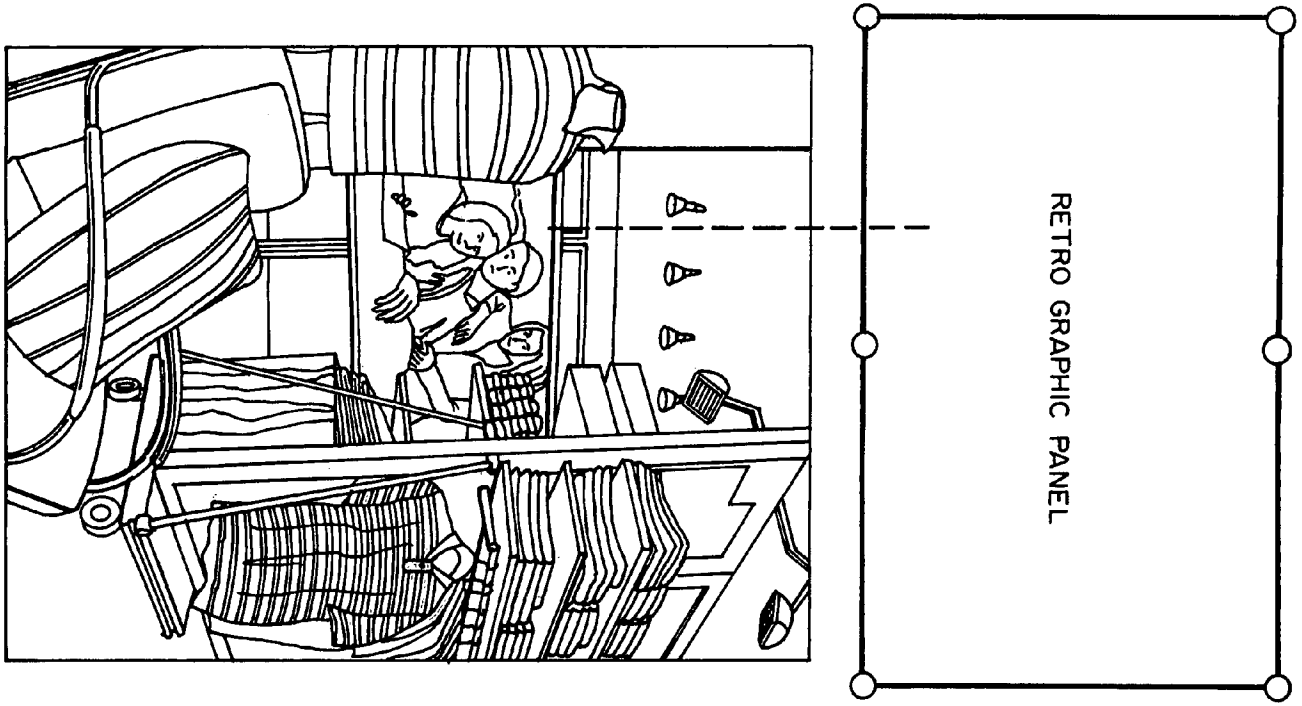
FIGS. 10 and 11 are respective illustrative examples of the system of FIG. 9.
Figure 9:
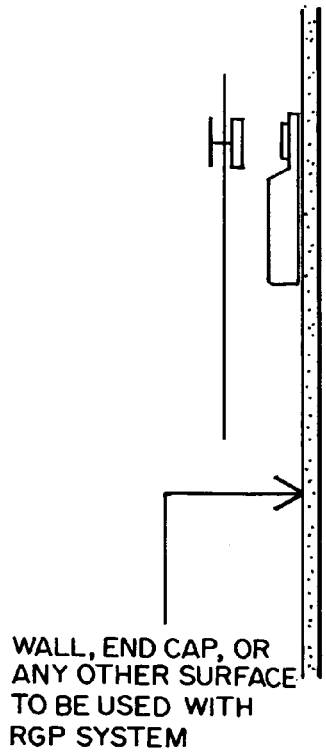
Figure 9A:
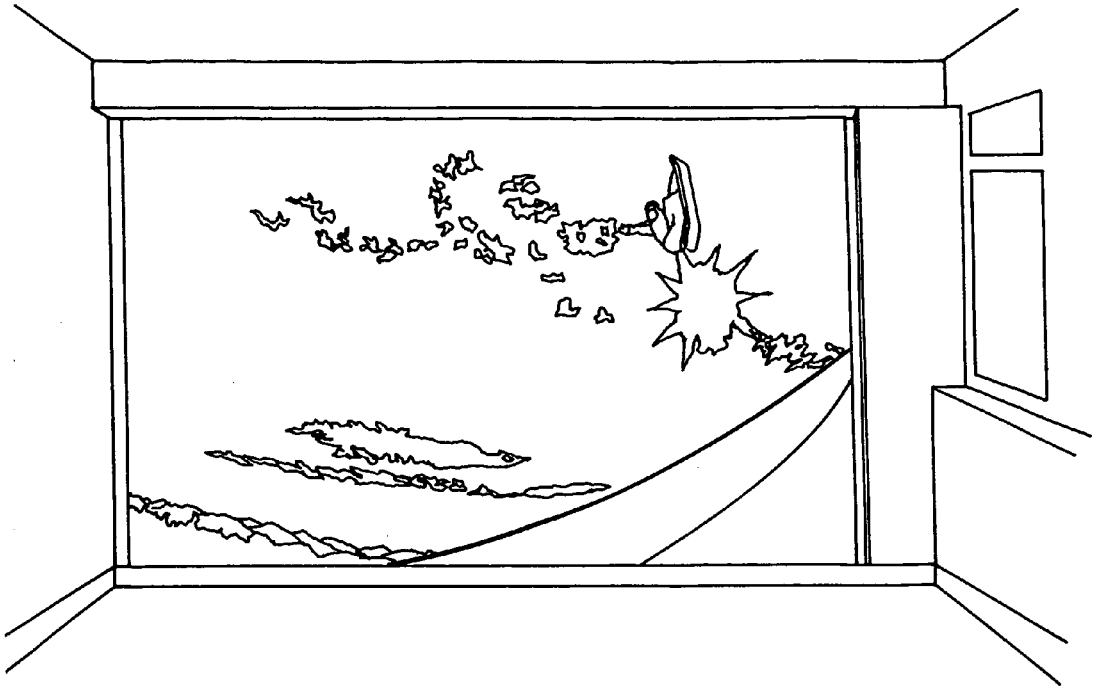
FIG. 9A is an illustration of an example of the system of FIG. 9 in which a sign is substantially equal in area to an entire wall surface to which the sign is magnetically attached.
Figure 11:
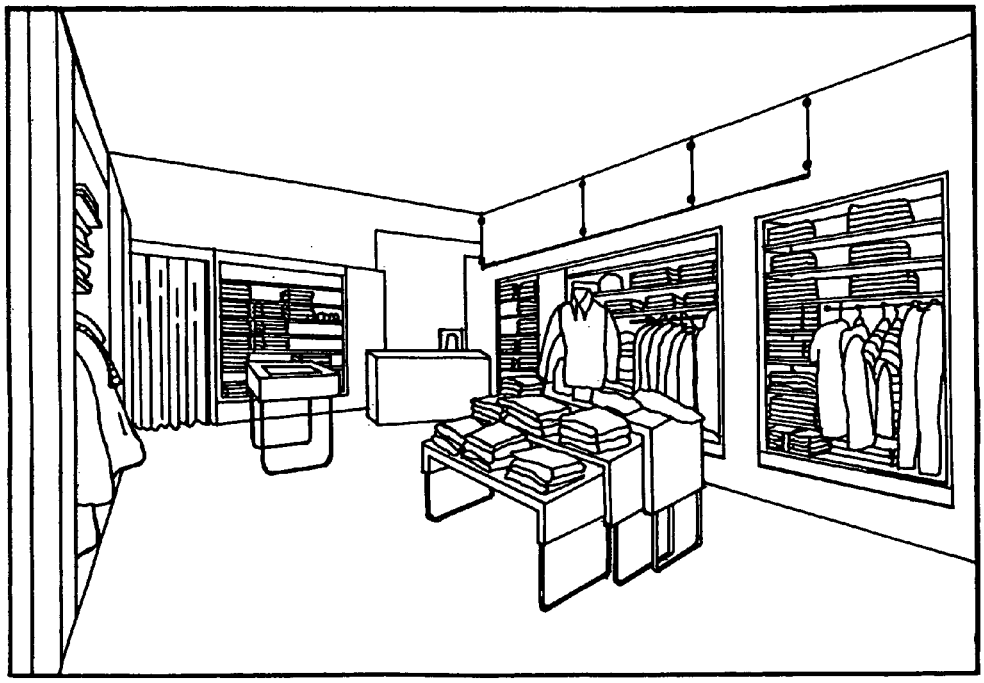

While the above-described embodiment of the present invention is most advantageous for use in restaurants and especially in fast food restaurants where customers rely primarily on signs, rather than on distributed menus to make their purchase selections, the magnet-based mounting concepts of the invention are also advantageous in many other types of retail stores. By way of example, FIGS. 9-11 illustrate the use of magnetically-based deployment of graphic panels in clothing stores and clothing departments of department stores. In this embodiment, graphic-receiving panels may be mounted on walls such as directly as shown schematically in FIG. 9, via backlighted translucent wall-mounted panels as shown in FIG. 11, or as fixture-mounted panels as shown in FIG. 10. The direct wall mounting configuration of FIG. 9 is particularly well-suited for very large graphic sheets, even those sufficiently large to cover an entire wall surface such as that shown in FIG. 9*a*. Such large graphics are preferably formed on synthetic substrates such as polycarbonate, polyethylene, ABS, polypropylene and thin styrene. These materials, while inherently more costly to print, produce significant savings in shipping, rolled up in tubes (up to 80% or more) because they "relax out" into a flat configuration after shipping and don't need to be shipped flat in large, heavy packages as required for paper or cardboard based graphic sheets.

Figure 12:
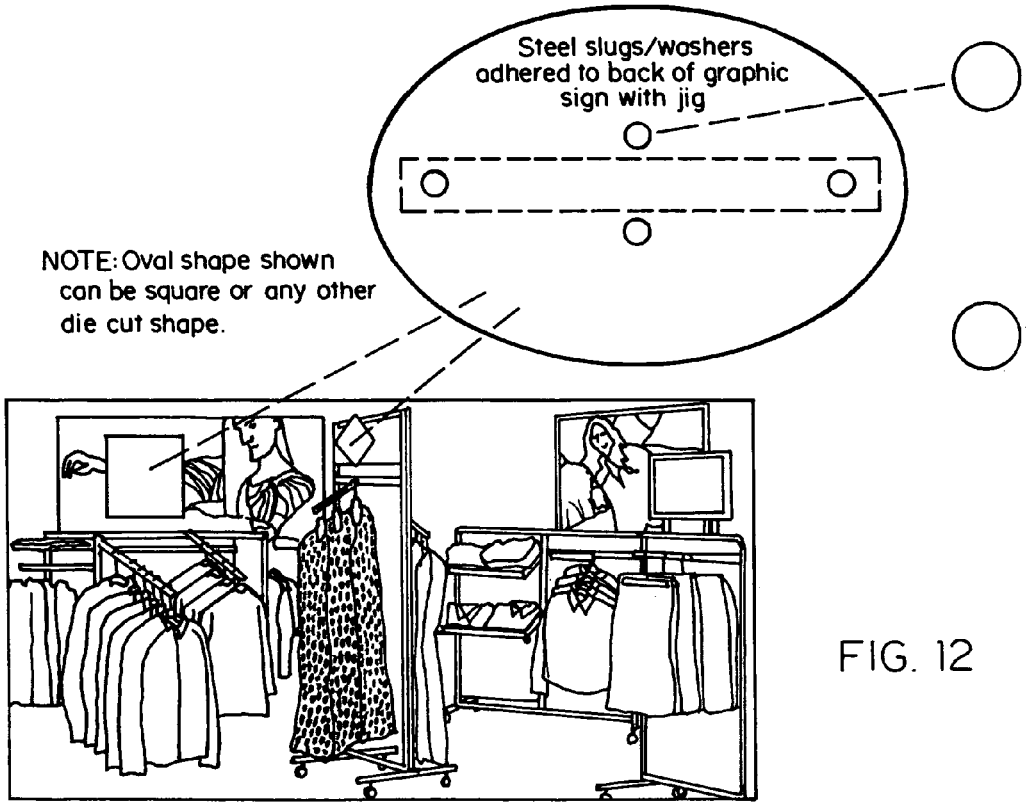
FIG. 12 is a schematic diagram showing the back surface of a graphic having multiple magnet attachment points for use on walls in a retail store.
Figure 13:
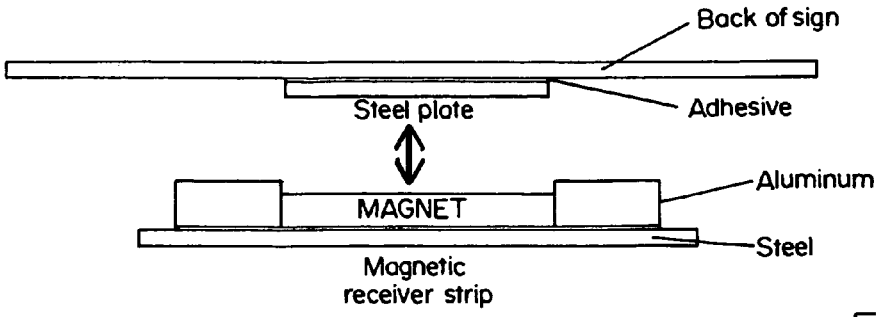
FIG. 13 is a schematic view of a typical attachment technique used in the graphic of FIG. 12.

As shown best in FIGS. 12 and 13, the large graphic sheet retail store embodiment of the invention can be installed in virtually any shape on any wall surface using magnetic receiver strips which can be adhered or screwed into any flat wall surface. Size and location options are virtually unlimited. Attachment of new or replacement graphic sheets is simple and easy and doesn't require any tools. Moreover, the magnet-based system permits self-positioning of the graphic sheets in exact locations both horizontally and vertically. The present invention is not limited to use on flat wall surfaces. FIGS. 14 through 18 illustrate the use of modular brackets for installation of graphics at corner locations, as well as along curved segments and at window frames.

Figure 14:
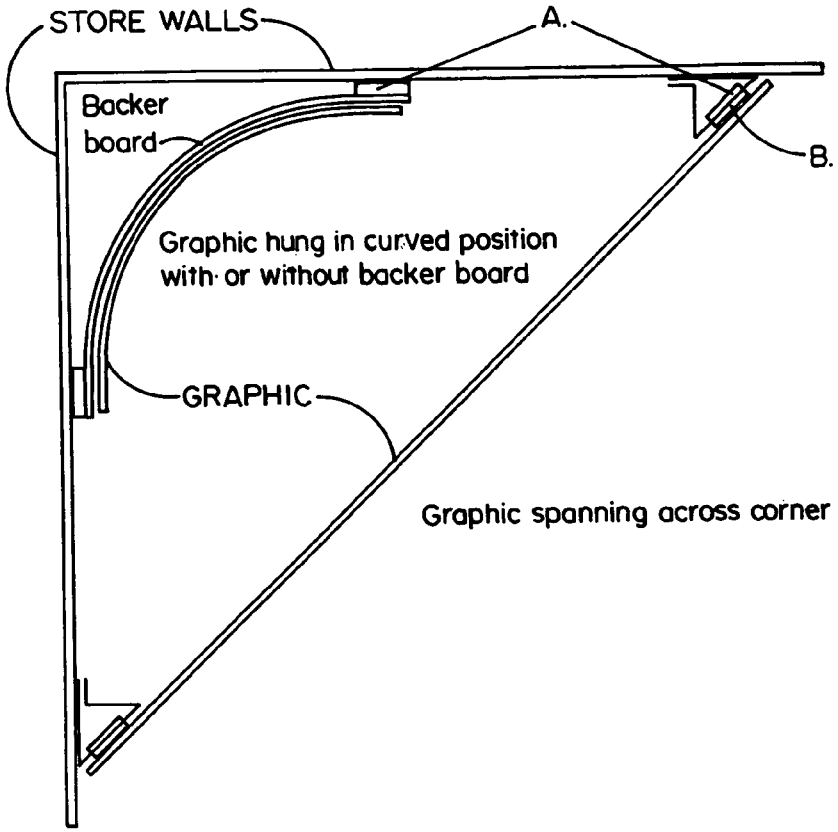
FIG. 14 is a schematic view of a wall corner of a retail store and showing different corner sign configurations attached using the present invention.
Figure 14:
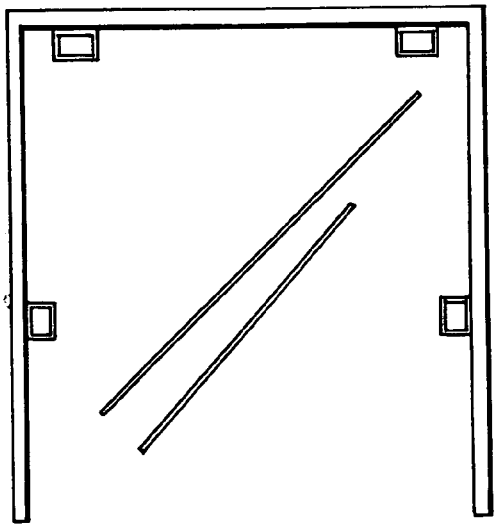
Figure 19:
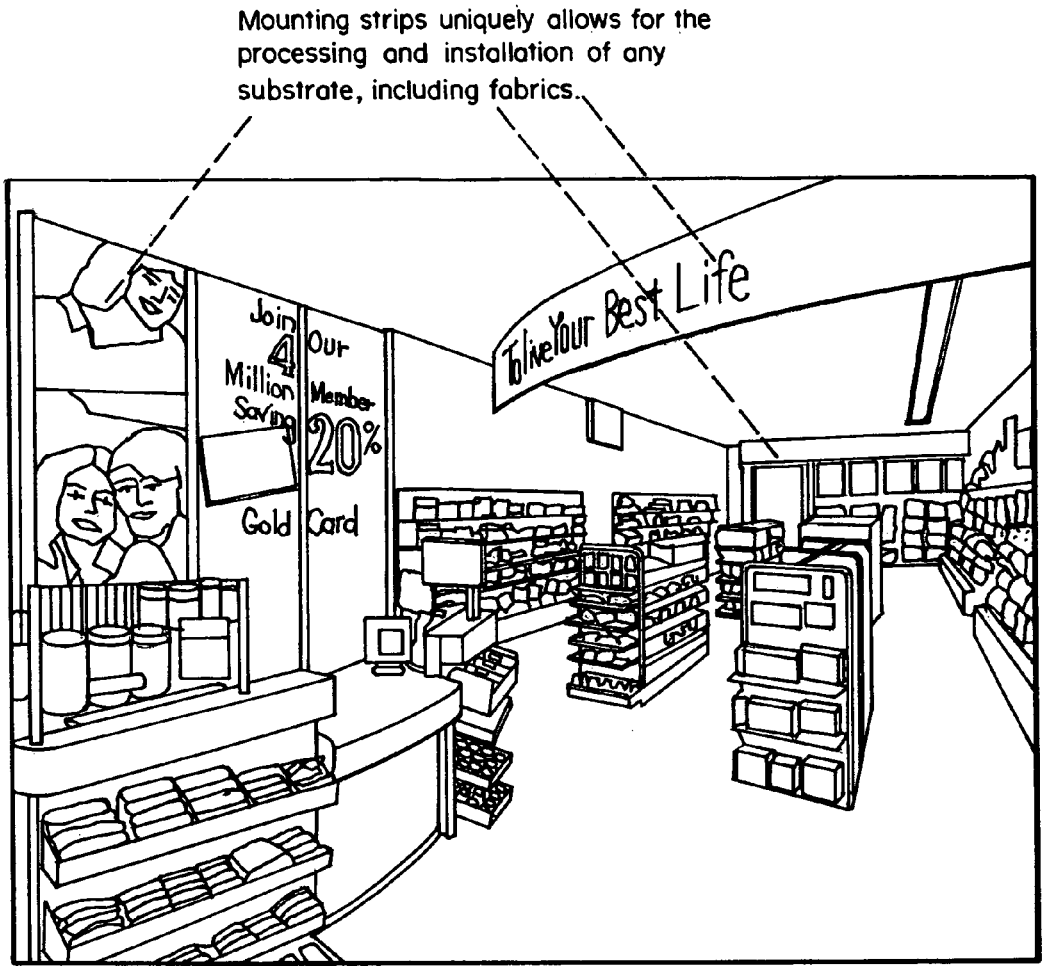
FIGS. 19-21 show examples of retail store signs resulting from use of the present invention.
Figure 20:
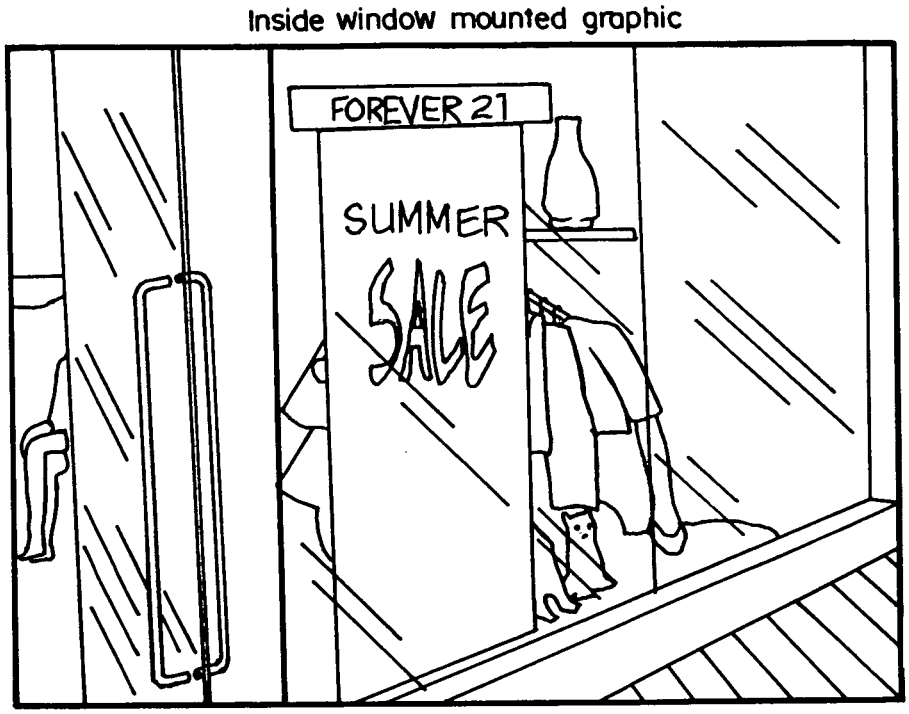
Figure 21:
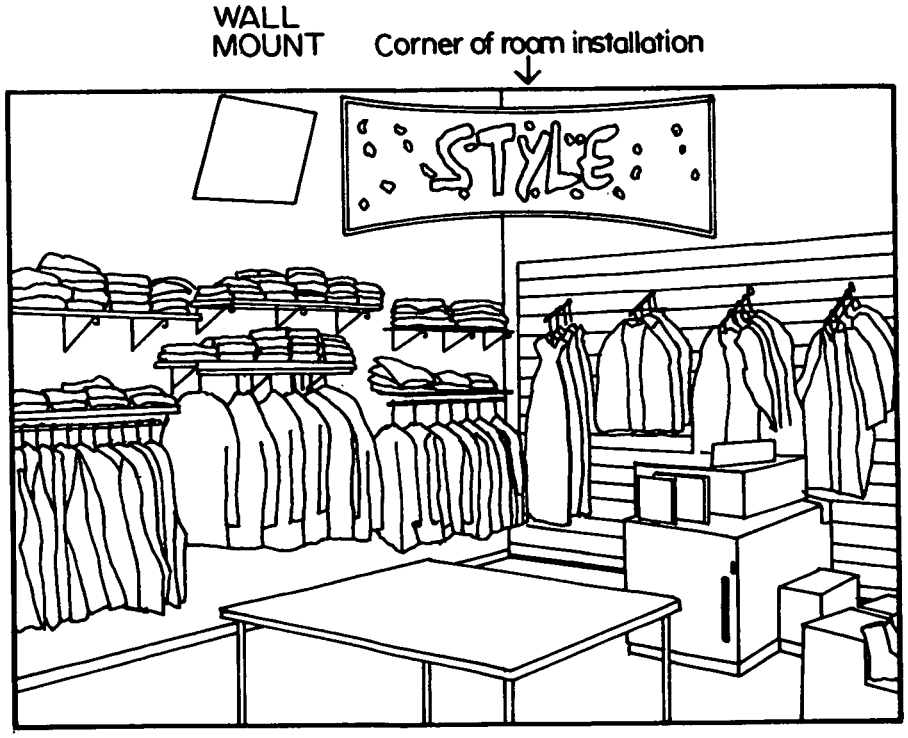

As shown in FIG. 14, graphic panels may be installed at corners of store walls near where walls meet at right angles for example. A modular bracket suitable for being affixed to each of the adjacent walls and having a magnet, is located for mating with a pre-positioned metal cap on each end of the corner graphic. A curved graphic panel such as also shown schematically in FIG. 14, may also be installed with or without a curved backer board depending upon the shape and stiffness of the graphic substrate. FIGS. 15, 16, 17 and 18 illustrate various alternative magnet-holding bracket configurations and mating metal-holding snap caps on an edge of graphic sheets. The snap caps are precisely pre-located on the respective graphic sheets so that the graphic is registered exactly, relatively to store walls, corner or window frame. Such installations are shown by way of example in FIGS. 19 to 21 including wall mounts, room corners, curved positions along ceilings and inside window displays.

Figure 22:
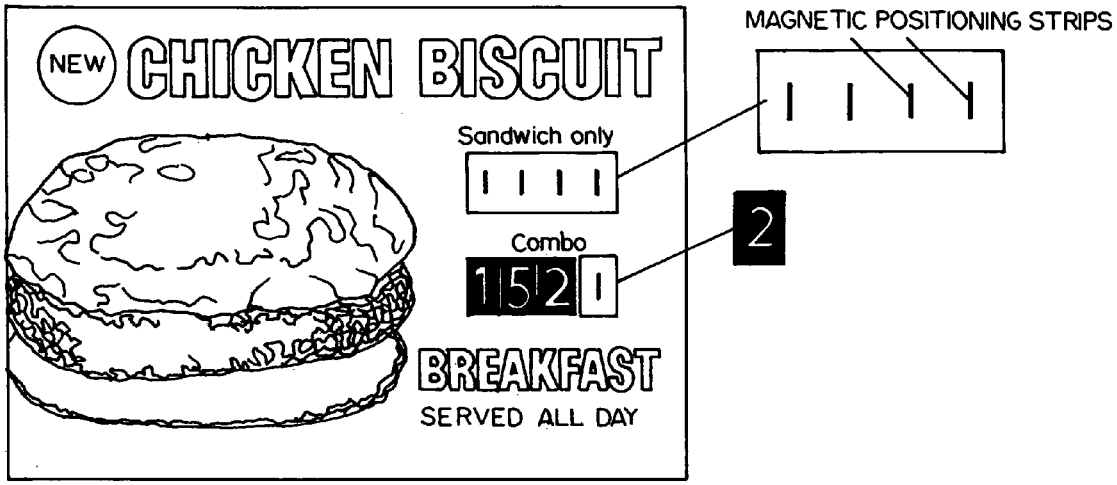
FIGS. 22 and 23 are examples of magnetic indicia carriers for use on specially prepared graphics of the present invention.
Figure 23:
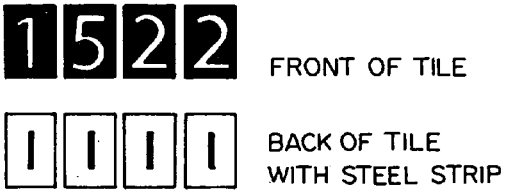

Referring to FIGS. 22 and 23, it will be seen that the use of magnets and mating metal devices is also useful as an alternative technique for deploying indicia carriers on selected graphic sheets that are provided with changeable data such as sizes, dates, times, weights, calorie content, or prices and the like. Such graphic sheets, such as shown by way of example in FIG. 22, have a portion thereof with precisely located magnetic positioning strips configured for receiving one or more indicia tiles. The fronts of the tiles each have some selected indicia such as a pre-selected number and the backs have a metal strip designed to mate precisely with a corresponding magnetic positioning strip on the graphic sheet as shown in FIG. 23.

Having thus disclosed preferred embodiments of the invention, it will now be understood that various modifications may be made while still utilizing the novel features thereof. By way of example, the precise size, position and shape of printed sheets may be modified. Moreover, the location, shape and number of magnets used to secure the printed sheets to a modular bracket or mounting board may be modified. In addition, where a disclosed embodiment shows a magnet and a metal device contacting one another to secure a sign to a surface, it will be understood that the magnet may be either on the sign or on the surface and the connecting metal device on the other. Therefore, it will be understood that the scope hereof is not limited by the disclosed preferred embodiments, but only by the appended claims and their equivalents.

I claim:

1. A readily modifiable signage apparatus comprising:

a wall having a planar surface for receiving a printed sheet thereon;

a plurality of printed sheets for being releasably affixed to said planar surface, each of said printed sheets and said planar surface having corresponding magnetic attraction devices affixed at selected locations for retaining at least one of said printed sheets on said planar surface in a precisely aligned position and for selective removal of one said printed sheet for replacement by another said printed sheet;

wherein said magnetic attraction devices comprise a respective metal device affixed to a rear surface of each said printed sheet and a magnet affixed to said planar surface of said wall and accessible for magnetic retention of said magnet to said metal device;

wherein each said respective metal device is affixed to said rear surface of a printed sheet through a respective sponge-like member interposed between said each metal device and a rear surface of a printed sheet.

2. The signage apparatus recited in claim 1 wherein said planar surface comprises at least one aperture extending from a front surface to a rear surface to make said magnet accessible to each said metal device on each said printed sheet.

3. The signage apparatus recited in claim 2 wherein said aperture is beveled adjacent said front surface to facilitate extending each said magnet into said aperture toward said metal surface.

4. The signage apparatus recited in claim 3 wherein said aperture is straight-walled adjacent said rear surface to facilitate retention of each said magnet within said aperture and prevent inadvertent movement of each said printed sheet on said planar surface.

5. The signage apparatus recited in claim 1 further comprising a mounting board which is translucent for passing light entering from a rear surface of said mounting board.

6. The signage apparatus recited in claim 1 wherein said printed sheets are each the same size as said entire planar surface of said wall.

7. A readily modifiable signage apparatus comprising:

a wall having a planar surface for receiving a printed sheet thereon;

a plurality of printed sheets for being releasably affixed to said planar surface, each of said printed sheets and said planar surface having corresponding magnetic attraction devices affixed at selected locations for retaining at least one of said printed sheets on said planar surface in a precisely aligned position and for selective removal of one said printed sheet for replacement by another said printed sheet;

wherein at least one of said printed sheets comprises an indicia carrier affixed on a front surface of said at least one printed sheet, said carrier having a plurality of accessible magnetic tiles on said printed sheet.

8. A method of modifying a sign; the method comprising the steps of;

a) providing a plurality of printed sheets and a wall having at least one designated area for receiving at least one of said printed sheets;

b) affixing magnetic attraction devices directly to both said printed sheets and said wall so that each said printed sheet will be positioned precisely in contiguous relation with said designated area when attached for magnetic attraction with said wall;

c) affixing a first printed sheet on said wall in said designated area so that said first sheet is held in place by said magnetic attraction devices with said first sheet in contact with said area;

d) pulling said first printed sheet away from said wall with sufficient force to overcome said magnetic attraction devices; and e) affixing a second printed sheet in said wall in said designated area in place of said first sheet so that said second sheet is held in place by said magnetic attraction devices with said second sheet in contact with said area;

f) affixing an indicia carrier to at least one of said printed sheets on a front surface of said at least one printed sheet and providing a set of number members for selective magnetic attachment to said indicia carrier to indicate data of a product referred to on said at least one printed sheet.

9. The method recited in claim 8 wherein step b) comprises the steps of attaching respective metal devices to said printed sheets and attaching a magnetic devices to said wall for receiving said magnetic devices in substantial contact with said metal devices.

* * * * *